US008353301B2

(12) United States Patent
Hampl, Jr. et al.

(10) Patent No.: US 8,353,301 B2
(45) Date of Patent: Jan. 15, 2013

(54) SMOKING ARTICLES HAVING REDUCED CARBON MONOXIDE DELIVERY

(75) Inventors: Vladimir Hampl, Jr., Roswell, GA (US); Alice Gu, Duluth, GA (US); Kerry Mahone, Alpharetta, GA (US)

(73) Assignee: Schweitzer-Mauduit International, Inc., Alpharetta, GA (US)

( * ) Notice: Subject to any disclaimer, the term of this patent is extended or adjusted under 35 U.S.C. 154(b) by 0 days.

(21) Appl. No.: 12/509,197

(22) Filed: Jul. 24, 2009

(65) Prior Publication Data

US 2009/0283104 A1 Nov. 19, 2009

Related U.S. Application Data

(63) Continuation of application No. 10/618,096, filed on Jul. 11, 2003, now abandoned.

(51) Int. Cl.
*A24B 15/18* (2006.01)

(52) U.S. Cl. ..... 131/334; 131/365

(58) Field of Classification Search ..... None
See application file for complete search history.

(56) References Cited

U.S. PATENT DOCUMENTS

| | | | | |
|---|---|---|---|---|
| 1,996,002 | A | 3/1935 | Seaman | |
| 2,003,690 | A | 6/1935 | Lewton | |
| 2,013,508 | A | 9/1935 | Seaman | |
| 2,366,187 | A * | 1/1945 | Friedwald | 131/284 |
| 2,776,912 | A | 1/1957 | Gregory | |
| 3,215,579 | A | 11/1965 | Hagen | |
| 3,353,541 | A | 11/1967 | Hind et al. | |
| 3,386,449 | A | 6/1968 | Hind | |
| 3,415,253 | A | 12/1968 | Michels et al. | |
| 3,420,241 | A | 1/1969 | Hind et al. | |
| 3,428,053 | A | 2/1969 | Schoenbaum et al. | |
| 3,467,109 | A | 9/1969 | Block et al. | |
| 3,472,237 | A | 10/1969 | Stephens | |
| 3,483,874 | A | 12/1969 | Hind | |
| 3,511,247 | A | 5/1970 | Tamol | |
| 3,526,904 | A | 9/1970 | Tamol | |
| 3,561,451 | A | 2/1971 | Jacin et al. | |
| 3,620,801 | A | 11/1971 | O'Grady | |

(Continued)

FOREIGN PATENT DOCUMENTS

DE 10146810 A1 4/2003

(Continued)

OTHER PUBLICATIONS

Hoffmann, Dietrich and Hoffmann, Ilse (1997), The Changing Cigarette, 1950-1995, Mar. 1997, Journal of Toxicology and Environmental Health, Part A,50:4, 307-364 DOI: 10.1080/009841097160393 URL:http://dx.doi.org/10.1080/009841097160393.*

MacEvoy, Bruce, Synthetic Inorganic Pigments, Jul. 2008, www.handprint.com/HP/WCL/pigmt1b.html, accessed Nov. 16, 2010.*

Product Data Sheet for Mapico® High-Purity Synthetic Iron Oxide Yellow 1135, Aug. 16, 2001.

(Continued)

*Primary Examiner* — Michael J Felton
(74) *Attorney, Agent, or Firm* — Dority & Manning, P.A.

(57) ABSTRACT

The present invention is directed to smoking articles having reduced carbon monoxide delivery are described. A carbon monoxide reducing agent is incorporated into the smoking article in order to reduce carbon monoxide levels in mainstream smoke. The carbon monoxide reducing agent may be, for instance, in metal oxide or in metal carbonate. The carbon monoxide reducing agent may be incorporated into a wrapper and/or into a column of smokable filler that are used to construct the smoking article.

20 Claims, 3 Drawing Sheets

U.S. PATENT DOCUMENTS

| | | | | |
|---|---|---|---|---|
| 3,621,851 | A | 11/1971 | Heskett et al. | |
| 3,699,973 | A | 10/1972 | Tamol et al. | |
| 3,736,940 | A | 6/1973 | Saint-Pastou | |
| 3,760,815 | A | 9/1973 | Deszyck | |
| 3,847,164 | A | 11/1974 | Mattina et al. | |
| 3,860,012 | A | 1/1975 | Selke | |
| 3,911,932 | A | 10/1975 | Houck, Jr. et al. | |
| 3,943,762 | A | 3/1976 | Baer | |
| 4,077,414 | A | 3/1978 | Baker et al. | |
| 4,129,134 | A | 12/1978 | Hind et al. | |
| 4,146,040 | A | 3/1979 | Cohn | |
| 4,182,349 | A | 1/1980 | Selke | |
| 4,193,412 | A | 3/1980 | Heim et al. | |
| 4,222,740 | A | 9/1980 | Bohrn et al. | |
| 4,267,240 | A | 5/1981 | Jaisle et al. | |
| 4,303,084 | A | 12/1981 | Simon | |
| 4,351,638 | A | 9/1982 | Finlayson, III et al. | |
| 4,452,259 | A | 6/1984 | Norman et al. | |
| 4,453,553 | A | 6/1984 | Cohn | |
| 4,481,960 | A | 11/1984 | Brooks | |
| 4,590,955 | A | 5/1986 | Dixit | |
| 4,607,647 | A | 8/1986 | Dashley et al. | |
| 4,615,345 | A | 10/1986 | Durocher | |
| 4,622,983 | A | 11/1986 | Mathews et al. | |
| 4,674,519 | A | 6/1987 | Keritsis et al. | |
| 4,679,575 | A | 7/1987 | Yamaguchi et al. | |
| 4,739,775 | A | 4/1988 | Hampl, Jr. | |
| 4,805,644 | A | 2/1989 | Hampl, Jr. et al. | |
| 4,880,870 | A | 11/1989 | Zimmermann et al. | |
| 4,889,145 | A | 12/1989 | Adams et al. | |
| 4,984,589 | A | 1/1991 | Riedesser | |
| 4,998,542 | A | 3/1991 | Kallianos et al. | |
| 5,040,551 | A | 8/1991 | Schlatter et al. | |
| 5,057,606 | A | 10/1991 | Garbe | |
| 5,060,673 | A | 10/1991 | Lehman | |
| 5,074,321 | A | 12/1991 | Gentry et al. | |
| 5,092,353 | A | 3/1992 | Montoya et al. | |
| 5,131,416 | A | 7/1992 | Gentry | |
| 5,143,099 | A | 9/1992 | Le Gars et al. | |
| 5,144,966 | A | 9/1992 | Washington | |
| 5,161,549 | A | 11/1992 | Rosario | |
| 5,170,807 | A | 12/1992 | Kasbo et al. | |
| 5,178,167 | A | 1/1993 | Riggs et al. | |
| 5,220,930 | A | 6/1993 | Gentry | |
| 5,221,502 | A | 6/1993 | Washington | |
| 5,261,425 | A | 11/1993 | Raker et al. | |
| 5,263,999 | A | 11/1993 | Baldwin et al. | |
| 5,271,419 | A | 12/1993 | Arzonico et al. | |
| 5,417,228 | A | 5/1995 | Baldwin et al. | |
| 5,468,266 | A | 11/1995 | Bensalem et al. | |
| 5,540,242 | A | 7/1996 | Chao et al. | |
| 5,690,787 | A | 11/1997 | Hultman et al. | |
| 5,715,844 | A | 2/1998 | Young et al. | |
| 5,722,433 | A | 3/1998 | Ishino et al. | |
| 5,724,998 | A | 3/1998 | Gellatly et al. | |
| 5,765,570 | A | 6/1998 | Litzinger et al. | |
| 5,820,998 | A | 10/1998 | Hotaling et al. | |
| 5,849,153 | A | 12/1998 | Ishino et al. | |
| 5,878,753 | A | 3/1999 | Peterson et al. | |
| 5,878,754 | A | 3/1999 | Peterson et al. | |
| 5,893,372 | A | 4/1999 | Hampl, Jr. | |
| 6,129,087 | A | 10/2000 | Wallace et al. | |
| 6,286,516 | B1 | 9/2001 | Bowen et al. | |
| 6,289,898 | B1 | 9/2001 | Fournier et al. | |
| 6,305,382 | B1 | 10/2001 | Hampl, Jr. | |
| 6,314,964 | B1 | 11/2001 | Hampl, Jr. | |
| 6,371,127 | B1 | 4/2002 | Snaidr | |
| 6,568,403 | B2 | 5/2003 | Hampl, Jr. et al. | |
| 6,606,999 | B2 | 8/2003 | Crooks et al. | |
| 6,615,842 | B1 | 9/2003 | Cerami et al. | |
| 6,637,439 | B2 | 10/2003 | Hajaligol et al. | |
| 6,645,605 | B2 | 11/2003 | Hammersmith et al. | |
| 6,679,270 | B2 | 1/2004 | Baskevitch et al. | |
| 6,725,867 | B2 * | 4/2004 | Peterson et al. | 131/365 |
| 6,769,437 | B2 * | 8/2004 | Hajaligol et al. | 131/364 |
| 6,779,530 | B2 | 8/2004 | Kraker | |
| 6,799,578 | B2 | 10/2004 | Snaidr et al. | |
| 6,810,884 | B2 | 11/2004 | Snaidr et al. | |
| 6,823,872 | B2 | 11/2004 | Hampl, Jr. | |
| 6,837,248 | B2 | 1/2005 | Zawadzki et al. | |
| 6,854,469 | B1 | 2/2005 | Hancock et al. | |
| 2002/0000235 | A1 | 1/2002 | Shafer et al. | |
| 2002/0062834 | A1 | 5/2002 | Snaidr et al. | |
| 2002/0139381 | A1 | 10/2002 | Peterson et al. | |
| 2002/0179106 | A1 | 12/2002 | Zawadzki et al. | |
| 2003/0041867 | A1 | 3/2003 | Hajaligol et al. | |
| 2003/0131860 | A1 | 7/2003 | Ashcraft et al. | |
| 2003/0136420 | A1 | 7/2003 | Kraker | |
| 2004/0011368 | A1 | 1/2004 | Tsutsumi et al. | |
| 2004/0020502 | A1 | 2/2004 | Tosas Fuentes et al. | |
| 2004/0020504 | A1 | 2/2004 | Snaidr et al. | |
| 2004/0094171 | A1 | 5/2004 | Wanna et al. | |
| 2004/0123874 | A1 | 7/2004 | Zawadzki et al. | |
| 2004/0177856 | A1 | 9/2004 | Monsalud, Jr. et al. | |
| 2004/0250828 | A1 | 12/2004 | Luan et al. | |
| 2004/0255966 | A1 | 12/2004 | Kraker | |
| 2005/0005947 | A1 | 1/2005 | Hampl, Jr. et al. | |
| 2005/0056294 | A1 | 3/2005 | Wanna et al. | |
| 2005/0076929 | A1 | 4/2005 | Fitzgerald et al. | |
| 2007/0084475 | A1 | 4/2007 | Oglesby | |
| 2007/0137668 | A1 | 6/2007 | Borschke et al. | |
| 2007/0246055 | A1 | 10/2007 | Oglesby | |
| 2008/0115794 | A1 | 5/2008 | Oglesby | |

FOREIGN PATENT DOCUMENTS

| | | | |
|---|---|---|---|
| EP | 0193607 | B1 | 9/1986 |
| EP | 0290911 | | 11/1988 |
| EP | 0386884 | A2 | 9/1990 |
| EP | 0419975 | A2 | 4/1991 |
| EP | 0419975 | A3 | 4/1991 |
| EP | 0458526 | A1 | 11/1991 |
| GB | 848332 | | 9/1960 |
| GB | 903067 | | 8/1962 |
| JP | 04-091776 | | 3/1992 |
| JP | 05-092140 | | 4/1993 |
| JP | 07-145395 | | 6/1995 |
| JP | 08-080182 | | 3/1996 |
| JP | 2000-093153 | | 4/2000 |
| JP | 2005-522206 | | 7/2005 |
| JP | 2006-520153 | | 8/2006 |
| JP | 2006-526996 | | 11/2006 |
| JP | 2007-511204 | | 5/2007 |
| JP | 2007-527698 | | 10/2007 |
| JP | 2007-527782 | | 10/2007 |
| WO | WO 0141590 | A1 | 6/2001 |
| WO | WO 0237991 | | 5/2002 |
| WO | WO 02067704 | A1 | 9/2002 |
| WO | WO 02078471 | A1 | 10/2002 |
| WO | WO 03/034846 | A1 | 5/2003 |
| WO | WO 03034845 | A1 | 5/2003 |
| WO | WO 03064165 | A1 | 8/2003 |
| WO | WO 03/086115 | A1 | 10/2003 |
| WO | WO 03092416 | A1 | 11/2003 |
| WO | WO 2004/002180 | A1 | 12/2003 |
| WO | WO 2004/110184 | A2 | 12/2004 |
| WO | WO 2004/110189 | A2 | 12/2004 |
| WO | WO 2005/002370 | A2 | 1/2005 |

OTHER PUBLICATIONS

Annex to Form PCT/ISA/206 for PCT/US2004/013656, Dec. 22, 2004.

Claims from Uruguay Patent Invention No. 28364 entitled "Shredded Paper Catalytically Filled With Tobacco Chopped Filling and Methods for the Elaboration Thereof", 20 pages, Publication Jan. 31, 2005.

Program Booklet and Abstracts, vol. 57, 57th Tobacco Science Research Conference, Sep. 21-24, 2003, Norfolk, Virginia, 2 pages.

Abstract of Article—The effect of tobacco ingredients on smoke chemistry. Part I: Flavourings and additives, R. R. Baker, Silva de Pereira, Jr., and G. Smith, Food Chem. Toxicol., vol. 42, 2004, Suppl:S3-37, 2 pages.

Search Report and Written Opinion for PCT/US2005/039090, Mar. 24, 2006.

European Search Report dated May 2, 2008.

* cited by examiner

SMOKING ARTICLES HAVING REDUCED CARBON MONOXIDE DELIVERY

RELATED APPLICATIONS

The present application is a Continuation application of U.S. patent application Ser. No. 10/618,096, filed on Jul. 11, 2003 now abandoned.

BACKGROUND OF THE INVENTION

Smoking articles such as cigarettes are conventionally made by wrapping a column of tobacco in a white wrapping paper. At one end, the smoking article usually includes a filter through which the article is smoked. Filters are attached to smoking articles using a tipping paper that is glued to the white wrapping paper. The wrapping papers and tipping papers used to construct smoking articles are typically made from flax or other cellulosic fiber and contain a filler, such as calcium carbonate. The column of tobacco, on the other hand, may contain shredded tobacco leaves alone or in combination with reconstituted tobacco.

Smoking articles such as cigars, on the other hand, are made by wrapping a plurality of tobacco leaves together. Cigars typically do not include a filter although various varieties are available that do contain a filtered tip.

When a smoking article is being enjoyed, a user puffs on one end of the smoking article after the smoking article has been lit on an opposite end. The smoke that is inhaled by the user is typically referred to as mainstream smoke. Mainstream smoke contains a variety of constituents that, in combination, provide the smoking article with a particular taste.

Some of the constituents contained in mainstream smoke, however, are scrutinized by government agencies and, therefore, may be undesirable in particular applications. For example, although carbon monoxide levels present in mainstream smoke are relatively low, the cigarette industry has recently been under significant pressure to reduce carbon monoxide levels even further. Such reduced levels may be necessary in the future in order to meet government regulations, such as in Europe or in the United States. As such, a need currently exists for a method of reducing carbon monoxide levels in smoking articles without interfering with the taste of the article or adversely affecting any other properties of the article.

SUMMARY OF THE INVENTION

In general, the present invention is directed to smoking articles having reduced carbon monoxide delivery. For example, in one embodiment, the present invention is directed to a smoking article containing a first component comprising a column of a smokable filler. The smokable filler may be shredded tobacco material. For example, the tobacco material may include shredded tobacco leaves, reconstituted tobacco, or mixtures thereof.

The smoking article also includes a second component comprising a wrapper surrounding the column of the smokable filler. The wrapper may have a single layer construction or a multi-layered construction.

In accordance with the present invention, the smoking article further contains a carbon monoxide reducing agent. The carbon monoxide reducing agent is contained within the first component, the second component, or in both components. The carbon monoxide reducing agent may be, for instance, a metal oxide or a metal carbonate. In one particular embodiment, the carbon monoxide reducing agent may be a Group VIII (as appearing on the periodic table) metal oxide, a Group VIII metal carbonate, or mixtures thereof. As used herein, the term "oxide" also refers to peroxides, hydroxides and the like. The carbon monoxide reducing agent is present in the smoking article in an amount sufficient to reduce carbon monoxide delivery by at least about 10% in milligrams per smoking article.

In particular, carbon monoxide reducing agents that may be used in the present invention include cobalt oxide, cobalt carbonate, calcium peroxide, palladium oxide, and platinum oxide. In one particular embodiment, a hydrated ferric oxide is used as the carbon monoxide reducing agent.

Smoking articles made in accordance with the present invention may have a carbon monoxide delivery of less than about 15 mg per smoking article, such as less than 12 mg per smoking article or even less than about 10 mg per smoking article. The smoking articles may have an average carbon monoxide per puff of less than about 1.75 mg, such as less than about 1.5 mg, 1.25 mg, or even less than about 1.0 mg. Additionally, the smoking articles can have a carbon monoxide to tar ratio of less than 1, such as less than 0.7 or less than 0.5.

The carbon monoxide reducing agent may be added to one or more components of the smoking article. For instance, in one embodiment, the carbon monoxide reducing agent is blended with the column of smokable filler. Alternatively, or in addition to being contained in the smokable filler, the carbon monoxide reducing agent may also be contained in the wrapper.

For example, in one embodiment, the carbon monoxide reducing agent may be contained in a single layer paper wrapper that forms the exterior surface of the smoking article. The paper wrapper may be made from pulp fibers and may contain a filler, such as calcium carbonate in addition to the carbon monoxide reducing agent. The wrapper may have a permeability of from about 15 Coresta units to about 110 Coresta units and may have a basis weight of about 15 gsm to about 60 gsm.

In another embodiment, the wrapper may include an outer layer and an inner layer. In this embodiment, the carbon monoxide reducing agent may be contained in the inner wrapper. The inner wrapper may be made from pulp fibers or may be a web of reconstituted tobacco. As used herein, a wrapper refers to and includes any web-like material that surrounds the smokable filler.

Recently, attention has also been focused on producing commercial smoking articles that have a reduced ignition proclivity, which is the tendency of a smoking article to ignite surfaces which come into contact with the lit article. Thus, those skilled in the art have been attempting to develop a smoking article that will continue to burn when left in the free air but will self-extinguish when dropped or left in a free burning state on a combustible material.

These smoking articles typically include lower permeability areas contained within the wrapper of the article at selected locations. The low permeability areas create a burn mode index range within the wrapper sufficient to reduce ignition proclivity by reducing oxygen to a smoldering coal of the smoking article as the coal burns and advances into the low permeability areas.

Unfortunately, the low permeability areas may have a tendency to increase the amount of carbon monoxide produced in the mainstream of the smoke of the article. In this regard, the teachings of the present invention are particularly well suited for use in combination with the above described smoking articles having reduced ignition proclivity properties.

In particular, the present invention, in one embodiment, is directed to a smoking article containing low permeability areas at selected locations. The low permeability areas, for instance, may comprise bands surrounding a smokable filler that extend either in a direction perpendicular to the axis of the article or parallel to the axis of the article. The bands can be made, for instance, from a cellulosic material that is deposited on the wrapper. Alternatively, a film-forming substance may also be applied to the wrapper in order to form the low permeability areas. In one embodiment, the low permeability areas are applied to the wrapper such that the wrapper has a BMI of less than about 8 $cm^{-1}$ within the low permeability areas.

In accordance with the present invention, the smoking article may also be produced having a carbon monoxide delivery of less than about 15 mg per smoking article, particularly less than 12 mg per smoking article, and in one embodiment, can have a carbon monoxide delivery of less than 10 mg per smoking article. The smoking article can also have a carbon monoxide to tar ratio of less than about 1.

In accordance with the present invention, the above smoking article can obtain the above characteristics through the use of a carbon monoxide reducing agent as described above and hereinafter.

Other features and aspects of the present invention are discussed in greater detail below.

BRIEF DESCRIPTION OF THE DRAWINGS

A full and enabling disclosure of the present invention, including the best mode thereof to one skilled in the art, is set forth more particularly in the remainder of this specification, including reference to the accompanying figures in which.

Figure 1:
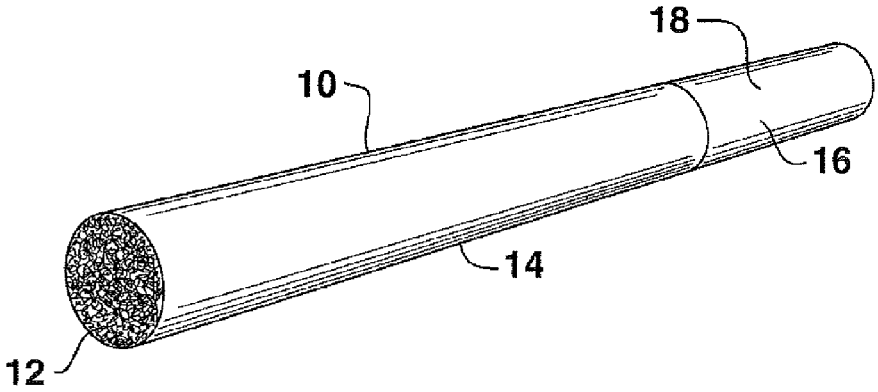
FIG. 1 is a perspective view of one embodiment of a smoking article made in accordance with the present invention.

Repeat use of reference characters in the present specification and drawings is intended to represent same or analogous features or elements of the present invention.

DETAILED DESCRIPTION

Reference will now be made in detail to present embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents.

In general, the present invention is directed to smoking articles having reduced carbon monoxide delivery. Specifically, the present inventors have discovered that the amount of carbon monoxide contained in mainstream smoke can be reduced in a smoking article by adding to the smoking article a carbon monoxide reducing agent, such as a metal oxide or a metal carbonate. The carbon monoxide reducing agent may be added to the smoking article in an amount sufficient to reduce the carbon monoxide delivery by at least 10%, particularly by at least 20%. For example, in one embodiment, the carbon monoxide delivery can be reduced by greater than about 40%.

In addition to reducing carbon monoxide, the carbon monoxide reducing agent in the present invention also reduces the carbon monoxide to tar ratio and maintains the ratio within desired ranges. For example, the carbon monoxide to tar ratio may be decreased by about 10%, such as by greater than about 20%.

In one embodiment, for instance, smoking articles and particularly cigarettes, may be made according to the present invention having a carbon monoxide delivery of less than about 15 mg per smoking article, such as less than about 12 mg per smoking article. In fact, smoking articles may be produced having a carbon monoxide delivery of less than about 10 mg per smoking article. In terms of carbon monoxide per puff, the smoking articles may have an average carbon monoxide delivery per puff of less than about 1.75 mg, less than about 1.5 mg, and less than about 1.25 mg. In one particular embodiment, the smoking article can have a carbon monoxide delivery per puff of less than about 1.0 mg.

Within the above ranges, the smoking article may have a carbon monoxide to tar ratio of less than about 1, such as less than about 0.7. For example, in one embodiment, the smoking article may have a carbon monoxide to tar ratio of less than about 0.5.

In general, the carbon monoxide reducing agent of the present invention may be a metal oxide or a metal carbonate. More particularly, the present invention is directed to metal oxides in metal carbonates that are capable of reducing carbon monoxide levels when contained in a smoking article. To discern whether or not a particular metal oxide or metal carbonate reduces carbon monoxide and mainstream smoke, a selected metal oxide or metal carbonate may be added to a smoking article and the smoking article may be tested according to standard tests as described in the examples below.

In one embodiment, the carbon monoxide reducing agent may be a metal oxide or a metal carbonate containing a Group VIII metal as appearing on the periodic table. The metal can be, for instance, iron, cobalt, nickel, ruthenium, rhodium, palladium, osmium, iridium, platinum, or mixtures thereof. Particular examples of metal oxides and metal carbonates that may be used according to the present invention include cobalt oxide, cobalt carbonate, calcium peroxide, palladium oxide, platinum oxide, and mixtures thereof.

In one particular embodiment, an iron oxide may be used as the carbon monoxide reducing agent. The iron oxide may be, for instance, ferric oxide. In one particular embodiment, ferric oxide associated with a water molecule is used (FeOOH). This particular ferric oxide has a yellow color and may be identified as hydrated ferric oxide. Yellow ferric oxide is commercially available, for instance, from Rockwood Pigments NA, Inc. of Beltsville, Md., under the trade name MAPICO yellow 1135, which is a high-purity synthetic iron oxide yellow. The synthetic iron oxide yellow is also referred to as Pigment Yellow 42 and is listed under Cas. No. 51274-00-1.

In general, the particle size of the carbon monoxide reducing agent is not believed to be critical. For most applications, however, the median particle size should be less than about 10 microns, such as less than about 5 microns. For example, in one embodiment, the particle size of the carbon monoxide reducing agent may be from about 0.01 microns to about 3 microns.

Figure 2:
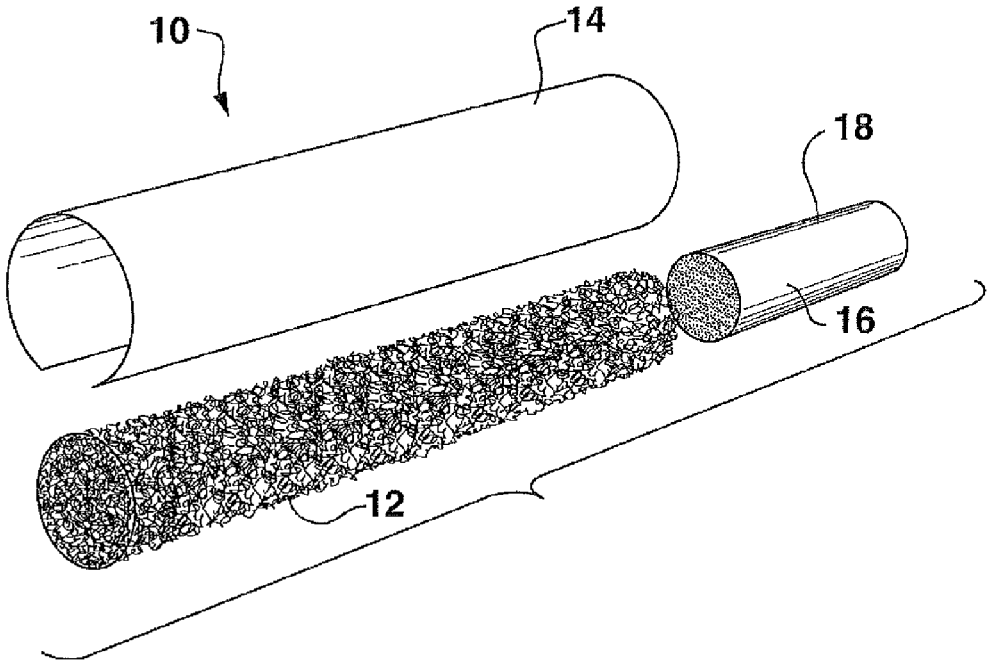
FIG. 2 is a disassembled perspective view of the smoking article illustrated in FIG. 1.

Referring to FIGS. 1 and 2, one embodiment of a smoking article made in accordance with the present invention is shown. In this embodiment, the smoking article is a cigarette 10. The cigarette 10 includes a column of a smokable filler 12 surrounded by a wrapper 14. Although optional, in this embodiment, the cigarette 10 further includes a filter 16. The filter 16 is attached to the cigarette 10 using a tipping paper 18.

In order to reduce the amount of carbon monoxide produced by the smoking article when lit, according to the present invention, a carbon monoxide reducing agent is incorporated into the smoking article. For instance, the carbon monoxide reducing agent may be incorporated into the wrapper 14, the smokable filler 12, or may be contained in both the wrapper and the smokable filler.

In general, the wrapper 14 in this embodiment can be made from cellulosic fibers obtained, for instance, from flax, softwood or hardwood. In order to vary the properties of the paper as desired, various mixtures of cellulosic fibers can be used. The extent to which the fibers are refined can also be varied.

The permeability of the wrapper can generally be from about 10 Coresta units to about 200 Coresta units. In some applications, the permeability can be between about 15 Coresta units to about 55 Coresta units. The basis weight of the wrapper, on the other hand, may be from about 15 gsm to about 60 gsm, and more particularly, between about 18 gsm to about 40 gsm. Wrappers made according to the present invention can be made within any of the above ranges.

In many applications, the wrapper may also be treated with a burn control additive, which may also serve as an ash conditioner. Such burn control additives can include, for instance, alkali metal salts, acetates, phosphate salts or mixtures thereof. For example, in one embodiment, the burn control additive may be potassium citrate, and/or sodium citrate. The burn control additive can be added to the wrapper in an amount from about 0.3% to about 5% by weight, and more particularly, from about 0.3% to about 2.5% by weight.

For most applications, the wrapper 14 may also contain a filler. The filler can be, for instance, calcium carbonate, magnesium oxide, or any other suitable material. The total filler loading added to the wrapper can be between about 10% to about 40% by weight.

When the carbon monoxide reducing agent is present in the wrapper 14, the carbon monoxide reducing agent may completely replace or partially replace the filler. For instance, depending upon the particular carbon monoxide reducing agent selected and the desired result, the carbon monoxide reducing agent may be added to the paper wrapper in an amount of at least about 3%, such as in an amount of at least about 5% by weight. In other embodiments, greater amounts can also be added including amounts greater than 10%, greater than 20%, greater than 30%, or even greater than 40%.

For many applications, as the amount of the carbon monoxide reducing agent is increased, the amount of filler contained in the wrapper is reduced. For instance, the wrapper may contain a filler and a carbon monoxide reducing agent in a total amount of from about 10% to about 60% by weight. The relative weight of either additive within the above range can vary.

It should be understood, however, that in other embodiments the amount of filler can remain constant and simply be combined with the carbon monoxide reducing agent, as long as the carbon monoxide reducing agent does not adversely interfere with any of the properties of the paper.

When incorporated into the wrapper, similar to the filler, the carbon monoxide reducing agent may be combined with cellulosic fibers during formation of the paper. In an alternative embodiment, however, the carbon monoxide reducing agent may be applied topically to the wrapper after the wrapper is formed. In this embodiment, a binder may be needed in order to secure the carbon monoxide reducing agent to a surface of the wrapper. The binder can be, for instance, any suitable adhesive material, such as a starch adhesive, that is safe for use in a smoking articles and that does not adversely interfere with the enjoyment of the article.

Applying the carbon monoxide reducing agent to a surface of the wrapper may be beneficial in situations where the carbon monoxide reducing agent affects the color of the wrapper. For instance, iron oxides may be red or yellow in color. In order to prevent these carbon monoxide reducing agents from affecting the white color of the wrapper, the agents may be adhered to the underside of the wrapper prior to construction of the smoking article.

Instead of or in addition to adding the carbon monoxide reducing agent to the wrapper 14, the carbon monoxide reducing agent can also be added to the column of smokable filler 12. The smokable filler 12 is generally made from tobacco alone or in combination with various other components. The tobacco may include, for instance, tobacco stems, such as flue-cured stems, fines, and tobacco byproducts, reconstituted tobacco, tobacco extracts, blends thereof, and other tobacco-containing materials. As shown in FIG. 2, the tobacco materials are usually chopped or shredded and then formed into the column 12.

When contained in the smokable filler 12, the carbon monoxide reducing agent may be added in amounts sufficient to decrease carbon monoxide levels by any desirable amount, such as by reducing carbon monoxide levels by at least 10%, such as at least 20%.

The amount of the carbon monoxide reducing agent added to the smokable filler 12 depends on the particular carbon monoxide reducing agent selected and the desired result. In some applications, for instance, the carbon monoxide reducing agent may be added to the column of smokable filler 12 in an amount greater than about 3% by weight, in an amount greater than about 5% by weight, or in an amount greater than about 10% by weight. In one embodiment, the carbon monoxide reducing agent may be added to the column of smokable filler 12 in an amount from about 3% by weight to about 40% by weight. Greater amounts, however, may be desired. Further, lesser amounts than about 3% may also be desired, especially in applications where a carbon monoxide reducing agent is also contained in other components of the smoking article.

When added to the column of smokable filler 12, the carbon monoxide reducing agent may simply be blended with the filler during formation of the column or of the smoking article. If desired, the carbon monoxide reducing agent may be added as a solution or may be combined with the smokable filler in conjunction with a binder.

Figure 3:
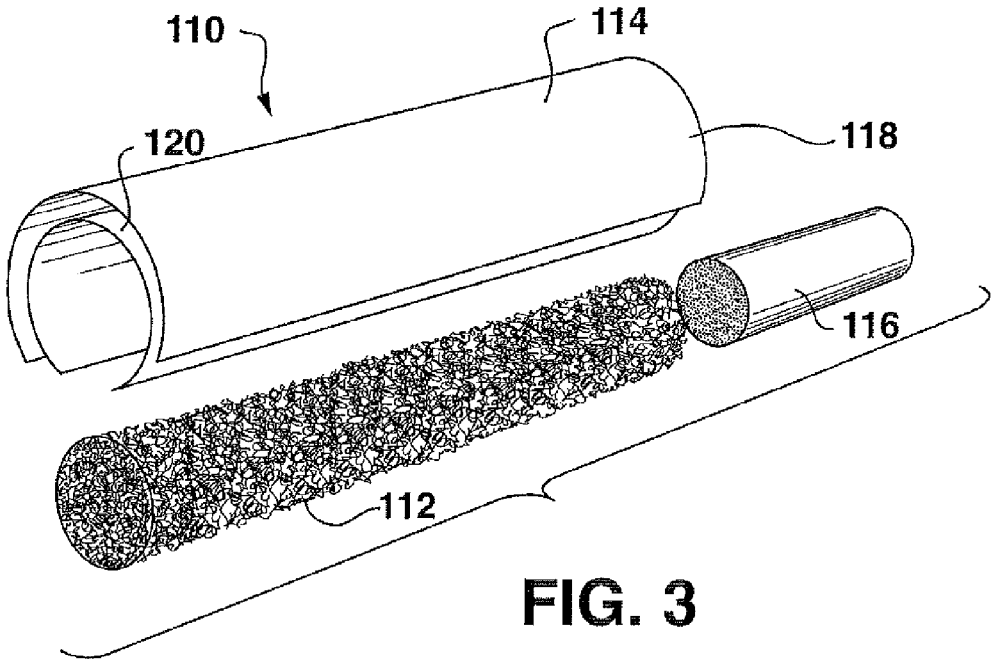
FIG. 3 is a disassembled perspective view of another embodiment of a smoking article made in accordance with the present invention.

Referring to FIG. 3, another embodiment of a smoking article generally 110 made in accordance with the present invention is shown. The smoking article 110 includes a column of smokable filler 112, a wrapper 114, and a filter 116. In this embodiment, the wrapper 114 includes an outer wrapper 118 and an inner wrapper 120. In accordance with the present invention, a carbon monoxide reducing agent is incorporated into the inner wrapper 120 for reducing carbon monoxide emissions by the smoking article when lit.

As discussed above, in some embodiments, the carbon monoxide reducing agent may have a particular color that changes the appearance of the outer wrapper 118 when present. For example, hydrated ferric oxide has a yellow color that may produce a yellow outer wrapper if incorporated into the wrapper in certain amounts. In some embodiments, colorizing the outer wrapper may produce a smoking article having an aesthetically appealing appearance. In other embodiments, however, it may be desirable to maintain the outer wrapper 118 white in color. In these embodiments, it may be preferable to include an inner wrapper 120 that contains the carbon monoxide reducing agent.

Double wrapped smoking articles are known in the art and are disclosed, for instance, in U.S. Pat. No. 5,143,099 which is incorporated herein by reference. For example, in one application, the inner wrapper 120 may be a highly permeable paper web that acts as a carrier for the carbon monoxide reducing agent. The inner wrapper 120, for instance, may have an air permeability of at least 500 Coresta units, such as at least 1000 Coresta units. For instance, the inner wrapper 120 may have a permeability of greater than about 1500 Coresta units, or even greater than about 3000 Coresta units. In order to increase the permeability of the inner wrapper, the inner wrapper may be perforated.

For many applications, the basis weight of the inner wrapper 120 is also relatively low. For instance, the basis weight may be below 20 gsm, such as below about 16 gsm. The inner wrapper 120 may be made from cellulosic fibers and may contain the carbon monoxide reducing agent alone or in conjunction with a filler.

Figure 4:
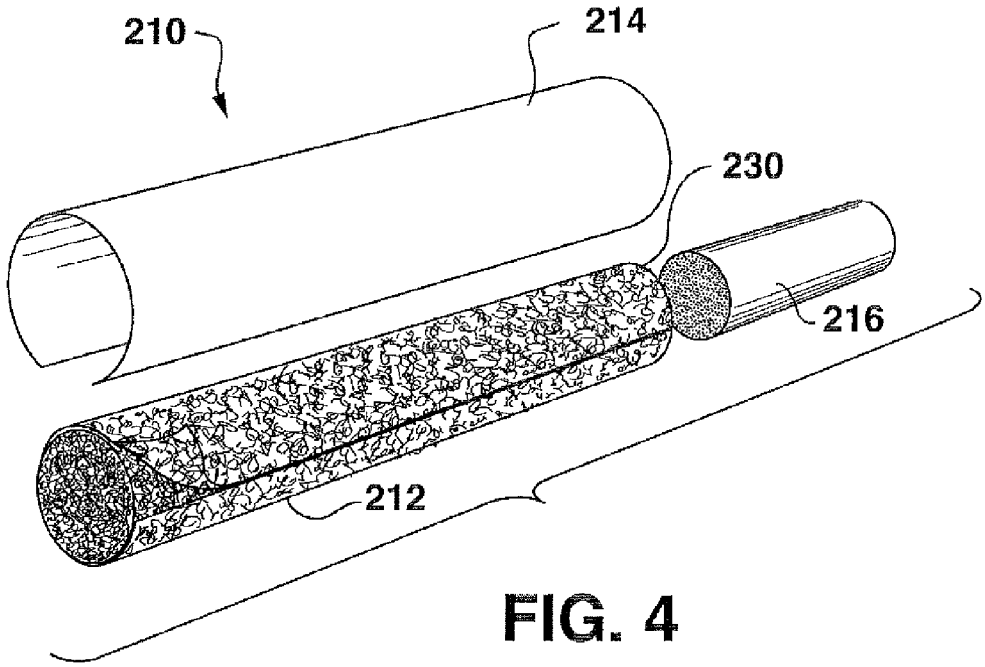
FIG. 4 is a disassembled perspective view of still another embodiment of a smoking article made in accordance with the present invention.

Referring to FIG. 4, another embodiment of a smoking article generally 210 is shown. The smoking article 210 includes a column of smokable filler 212, a wrapper 214, and a filter 216. In this embodiment, however, the smoking article 210 further includes an inner wrapper 230 surrounding the smokable filler 212 that is made from, for instance, a web of reconstituted tobacco. According to the present invention, the carbon monoxide reducing agent may be added to the web of reconstituted tobacco. Similar to the embodiment in FIG. 3, adding the carbon monoxide reducing agent to a web of reconstituted tobacco may prevent any discolorations in the outer wrapper 214.

In order to produce a web of reconstituted tobacco, for instance, a tobacco furnish containing tobacco stems (e.g., flue-cured stems), fines and/or other tobacco by-products from tobacco manufacturing processes is initially mixed with a solvent (e.g., water and/or other compounds). For example, various solvents that are water-miscible, such as alcohols (e.g., ethanol), can be combined with water to form an aqueous solvent. The water content of the aqueous solvent can, in some instances, be greater than 50% by weight of the solvent, and particularly greater than 90% by weight of the solvent. Deionized water, distilled water or tap water may be employed. The amount of the solvent in the suspension can vary widely, but is generally added in an amount from about 75% to about 99% by weight of the suspension. However, the amount of solvent can vary with the nature of the solvent, the temperature at which the extraction is to be carried out, and the type of tobacco furnish.

After forming the solvent/tobacco furnish mixture, some or all of a soluble portion of the furnish mixture may be optionally separated (e.g., extracted) from the mixture. If desired, the aqueous solvent/tobacco furnish mixture can be agitated during extraction by stirring, shaking or otherwise mixing the mixture in order to increase the rate of extraction. Typically, extraction is carried out for about one-half hour to about 6 hours. Moreover, although not required, typical extraction temperatures range from about 10° C. to about 100° C.

Once extracted, the insoluble, solids portion can optionally be subjected to one or more mechanical refiners to produce a fibrous pulp. Some examples of suitable refiners can include disc refiners, conical refiners, and the like. The pulp from the refiner can then be transferred to a papermaking station (not shown) that includes a forming apparatus, which may include, for example, a forming wire, gravity drain, suction drain, felt press, Yankee dryer, drum dryers, etc. In such a forming apparatus, the pulp is laid onto a wire belt forming a sheet-like shape and excess water is removed by the gravity drain and suction drain and presses. Once separated from the insoluble portion of the tobacco solution, the soluble portion can optionally be concentrated using any known type of concentrator, such as a vacuum evaporator.

Although optional, the soluble portion can then be recombined with the web to form reconstituted tobacco (filler or binder-wrapper). Specifically, the soluble portion can be reapplied to the sheet, using various application methods, such as spraying, using sizing rollers, saturating, and the like. Reconstituted tobacco can generally be formed in a variety of ways. For instance, in one embodiment, band casting can be utilized to form the reconstituted tobacco. Band casting typically employs a slurry of finely divided tobacco parts and a binder that is coated onto a steel band and then dried. After drying, the sheet is blended with natural tobacco strips or shredded and used in various tobacco products, including as a cigarette filler. Some examples of process for producing reconstituted tobacco are described in U.S. Pat. Nos. 3,353,541; 3,420,241; 3,386,449; 3,760,815; and 4,674,519; which are incorporated herein in their entirety by reference thereto. Reconstituted tobacco can also be formed by a papermaking process. Some examples of processes for forming reconstituted tobacco according to this process are described in U.S. Pat. Nos. 3,428,053; 3,415,253; 3,561,451; 3,467,109; 3,483,874; 3,860,012; 3,847,164; 4,182,349; 5,715,844; 5,724,998; and 5,765,570; which are also incorporated herein in their entirety by reference thereto for all purposes. For example, the formation of reconstituted tobacco using papermaking techniques can involve the steps of mixing tobacco with water, extracting the soluble ingredients therefrom, concentrating the soluble ingredients, refining the tobacco, forming a web, reapplying the concentrated soluble ingredients, drying, and threshing.

In addition, various other ingredients, such as flavor or color treatments, can also be applied to the web. If applied with the soluble portion and/or other ingredients, the fibrous sheet material can, in some embodiments, then be dried using, for example, a tunnel dryer, to provide a sheet having a typical moisture content of less than 20% by weight, and particularly from about 9% to about 14% by weight. Subsequently, the sheet can be cut to a desired size and/or shape and dried to the desired final moisture content.

In accordance with the present invention, a carbon monoxide reducing agent may be incorporated into the reconstituted tobacco web. The web may then be used as an inner wrapper 230 as shown in FIG. 4. The amount of the carbon monoxide reducing agent added to the reconstituted tobacco web 230 may depend on various factors. In general, the carbon monoxide reducing agent may be added to the reconstituted tobacco web in an amount from about 3% to about 40% by weight, such as from about 15% to about 35% by weight. Greater or lesser amounts, however, may be desired in certain applications. In fact, in one embodiment, greater that 50% by weight of the carbon monoxide reducing agent may be incorporated into the reconstituted tobacco web 230.

When incorporated into reconstituted tobacco as described above, the reconstituted tobacco may form an inner wrapper 230 as shown in FIG. 4. Alternatively, the reconstituted tobacco may be shredded and formed into the smokable filler 212.

Figure 5:
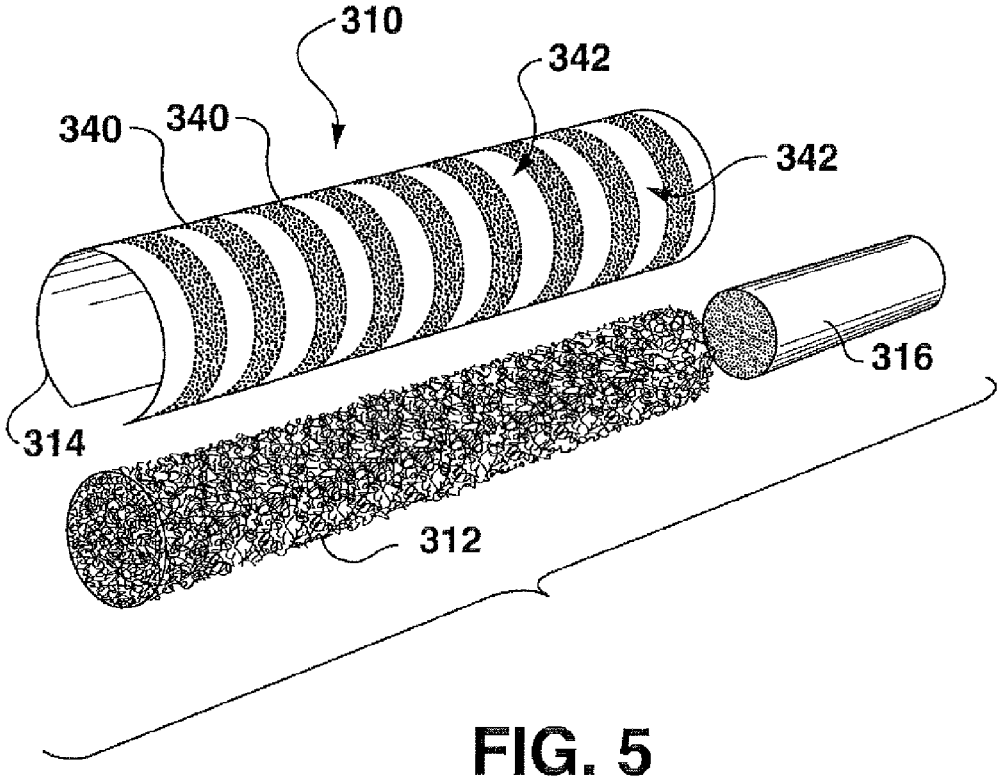
FIG. 5 is a disassembled perspective view of another embodiment of a smoking article made in accordance with the present invention.

Still another embodiment of a smoking article generally 310 made in accordance with the present invention as shown in FIG. 5. The smoking article 310 includes a column of smokable filler 312, a wrapper 314, and a filter 316. In this embodiment, the wrapper 314 includes low permeability areas 340 that form bands on the wrapper 314. The lower permeability areas 340 produce a smoking article having improved ignition proclivity control characteristics. "Ignition proclivity" is a measure of the tendency of the smoking article or cigarette to ignite a flammable substrate if the burning cigarette is dropped or otherwise left on a flammable substrate. A test for ignition proclivity of a cigarette has been established by NIST (National Institute of Standards and Technology) and is generally referred to as the "Mock-Up Ignition Test". The test comprises placing a smoldering cigarette on a flammable test fabric and recording the tendency of the cigarette to either ignite the test fabric, burn the test fabric beyond a normal char line of the fabric, burn its entire length without igniting the fabric, or self-extinguish before igniting the test fabric or burning its entire length.

Another test for ignition proclivity is referred to as the "Cigarette Extension Test". In the Cigarette Extension Test, a lit cigarette is placed on one or more layers of a filter paper. If the cigarette self-extinguishes, the cigarette passes the test. If the cigarette burns all the way to its end on the filter, however, the cigarette fails. Smoking articles made in accordance with this embodiment of the present invention can be designed to pass one or both of these tests.

In order to produce a smoking article having reduced emission proclivity characteristics, as shown in FIG. 5, the wrapper 314 includes the lower permeability areas 340. The lower permeability areas 340 form bands on the wrapper 314. In the embodiment shown in FIG. 5, the bands are perpendicular to the axis of the cigarette 310. In other embodiments, however, it should be appreciated that the bands may be parallel to the axis of the smoking article or may be placed on the wrapper 314 in a spiral arrangement. In still further embodiments, the lower permeability areas 340 may appear on the wrapper 314 in any type of suitable pattern that includes the lower permeability areas 340 separated by or placed in conjunction with relatively higher permeability areas 342.

In the embodiments shown in FIG. 5, the lower permeability areas 340 form bands that are spaced apart from each other longitudinally along the length of the wrapper 314. For most applications, the lower permeability areas 340 are essentially invisible in the formed cigarette. In other words, a smoker may not discern from any outward sign that the wrapper 314 includes the lower permeability areas 340.

When appearing as bands as shown in FIG. 5, the width and spacing of the bands are dependent upon a number of variables, such as the initial permeability of the wrapper 314, density of the tobacco column 312, etc. The bands have a width so that oxygen is limited to the burning coal for a sufficient length of a period of time to extinguish the coal. In other words, if the bands were too narrow, the burning coal would burn through the bands before self-extinguishing when placed on an adjacent surface. For some applications, for instance, the bands may have a width of at least 3 millimeters, such as from about 5 millimeters to about 10 millimeters.

The spacing between the bands is also a factor of a number of variables. The spacing should not be so great that a cigarette burns for a sufficient length of time to ignite a substrate before the coal ever burns into a lower permeability area. The spacing between the bands also affects the thermal inertia of the burning coal, or the ability of the coal to burn through the bands without self-extinguishing. In general, band spacings of between about 1 millimeter to about 30 millimeter are appropriate and particularly, between about 10 millimeters to about 25 millimeters.

The lower permeability areas 340 have a permeability within a range that is known to provide improved ignition proclivity characteristics for the cigarette 310. For instance, the lower permeability areas may have a permeability of less than about 20 Coresta units, such as less than about 12 Coresta units. For instance, the lower permeability areas 340 may have a permeability within a range of from about 2 Coresta units to about 8 Coresta units.

Besides permeability, another measurement that can be used to indicate reduced ignition proclivity properties is Burn Mode Index. In fact, the Burn Mode Index of a wrapper can be more accurate in indicating the burning characteristics of a wrapper as opposed to simply measuring the permeability of the wrapper. The test for determining Burn Mode Index is explained in U.S. Pat. No. 4,739,775 to Hampl, which is incorporated herein by reference.

In order to exhibit reduced ignition proclivity properties, the Burn Mode Index of the lower permeability areas 340 can be generally less than about 8 $cm^{-1}$, and particularly, from about 1 $cm^{-1}$ to about 5 $cm^{-1}$. For instance, in one embodiment, the Burn Mode Index of the lower permeability areas can be from about 1 $cm^{-1}$ to about 3 $cm^{-1}$.

The lower permeability areas 340 may be formed on the wrapper 314 in various ways. For example, in one embodiment, the lower permeability areas 340 may be formed in integral with the wrapper 314 by, for instance, densifying the wrapper or providing the wrapper with thickened areas.

In another embodiment, the lower permeability areas 340 may be formed from a cellulosic material. For example, in one embodiment, a separate paper web may be laminated to the wrapper 314. In another embodiment, a cellulosic composition may be deposited directly onto the wrapper 314.

In still another embodiment, the lower permeability areas 340 may be formed by applying a film-forming composition to the wrapper 314. For example, film-forming materials that can be used include alginates, guar, pectin, polyvinyl alcohol, cellulosic derivatives such as ethyl cellulose, methyl cellulose, and carboxymethyl cellulose, starch, starch derivatives, mixtures thereof and the like. Alginates can include, for instance, potassium alginate, sodium alginate, propylene glycol alginate, and/or mixtures thereof.

The film-forming composition can be printed or sprayed onto the wrapper 314 using any suitable process.

Although the lower permeability areas 340 produce a smoking article having reduced ignition proclivity characteristics. In some embodiments, the lower permeability areas 340 may increase the amount of carbon monoxide that is produced by the smoking article. Thus, the teachings of the present invention are particularly well suited for the use in conjunction with the type of smoking articles illustrated in FIG. 5 and described above. In particular, a carbon monoxide reducing agent may be incorporated into the wrapper 314 into the smokable filler 312 or into both components in order to reduce carbon monoxide emissions even in the presence of the lower permeability areas 340.

For instance, a carbon monoxide reducing agent may be added to the smoking article in an amount sufficient to reduce carbon monoxide emissions by at least 10%. For instance, the smoking article may have a carbon monoxide delivery of less than about 15 mg per smoking article and may have a carbon monoxide to tar ratio of less than 1.0. Further, the average carbon monoxide delivery per puff can be less than about 1.75 mg.

The combination of the carbon monoxide reducing agent in conjunction with a smoking article having reduced ignition proclivity characteristics is believed to produce an overall smoking article having unique properties not before realized.

The present invention may be better understood with reference to the following examples.

EXAMPLES

Example 1

The following tests were conducted in order to demonstrate the teachings of the present invention and to show reductions in carbon monoxide delivery in smoking articles.

Hand sheets were made containing cellulosic fibers in combination with either a conventional filler or a carbon monoxide reducing agent in accordance with the present invention. All of the carbon monoxide reducing agents used in this example were forms of iron oxide.

The control contained calcium carbonate sold under the trade name ALBACAR 5970. ALBACAR 5970 calcium carbonate has a median particle size of about 1.9 microns.

Each of the hand sheets had a basis weight of about 30 gsm and contained the filler or the carbon monoxide reducing agent in an amount of about 30%. The hand sheets had a permeability of 15 Coresta units.

Each of the trial papers was used to form cigarettes. The cigarettes were tested using a Model R04 Smoking Machine, manufactured by Borgwaldt Technik GmbH of Hamburg, Germany, which staged a 35 mL, 2 second puff of the cigarette through a pre-weighed Cambridge Filter pad once every minute. The process continued until the embers of the cigarette were 3 mm from the edge of the tipping paper for the filter. The number of puffs required to reach the designated distance from the tipping paper was deemed the puff count.

At the end of the testing, the Cambridge Filter pad, now containing a brown smoke stain, was removed from the smoking machine and reweighed. The difference in weight of the filter pad before and after testing is the amount of wet tar delivered in the mainstream smoke, designated in mg/cigarette. The filter pad was then subjected to a gas chromatograph analysis, which determined the percent water and the percent nicotine on the used filter pad. These values were converted to mass values and subtracted from the mass of wet tar to determine the mass of dry tar, also designated in mg/cigarette.

In the determination of the amount of mainstream carbon monoxide delivered by the cigarette, the mainstream smoke was collected and analyzed by a Model C21 Carbon Monoxide Analyzer, manufactured by Borgwaldt Technik GmbH of Hamburg, Germany. The percentage of carbon monoxide in the smoke was determined and then converted to units of mg/cigarette with respect to the total amount of mainstream smoke.

The following results were obtained:

TABLE 1

| | CO (%) | CO2 (%) | O2 (%) | Wet Tar (g/cig) | Wet Tar (mg/cig) | Puff Count | CO (mg) | CO2 (mg) |
|---|---|---|---|---|---|---|---|---|
| Control | 5.12 | 10.09 | 11.63 | 0.0323 | 32.3 | 8.17 | 16.9 | 52.5 |
| $Fe_2O_3 \cdot xH_2O$ | 2.19 | 7.01 | 14.94 | 0.0169 | 16.9 | 6.67 | 5.9 | 29.8 |
| $Fe_2O_3$ | 3.34 | 7.8 | 13.76 | 0.0201 | 20.1 | 8.33 | 11.3 | 41.3 |
| Blended Oxides | 3.1 | 7.77 | 13.95 | 0.0218 | 21.8 | 7.67 | 9.6 | 37.9 |
| $Fe_3O_4$ | 4.72 | 9.31 | 12.07 | 0.0301 | 30.1 | 8 | 15.3 | 47.4 |

| | O2 (mg) | CO/Tar (mg/mg) | CO/Puff (mg/puff) | $CO_2$/Puff (mg/puff) | O2/puff (mg/puff) | CO2/CO | Wet Tar/Puff (mg/puff) |
|---|---|---|---|---|---|---|---|
| Control | 44.0 | 0.52 | 2.07 | 6.42 | 5.38 | 3.10 | 3.95 |
| $Fe_2O_3 \cdot xH_2O$ | 46.1 | 0.35 | 0.89 | 4.46 | 6.91 | 5.03 | 2.53 |
| $Fe_2O_3$ | 53.0 | 0.56 | 1.35 | 4.96 | 6.37 | 3.67 | 2.41 |
| Blended Oxides | 49.5 | 0.44 | 1.26 | 4.94 | 6.45 | 3.94 | 2.84 |
| $Fe_3O_4$ | 44.7 | 0.51 | 1.91 | 5.92 | 5.58 | 3.10 | 3.76 |

Example 2

In this example, further hand sheets were made all having a total filler loading of about 30% by weight. The hand sheets had a permeability of about 20 Coresta units and had a basis weight of about 30 gsm. As in Example 1, the control contained ALBACAR 5970 calcium carbonate in an amount of 30% by weight.

Three other hand sheets were constructed in accordance with the present invention. In particular, in two of the hand sheets, a portion of the calcium carbonate filler was replaced by hydrated iron oxide. In the third trial paper, the calcium carbonate was completely replaced by hydrated iron oxide.

The tests described in Example 1 were repeated and the following results were obtained:

TABLE 2

| | CO (%) | CO2 (%) | O2 (%) | Wet Tar (g/cig) | Wet Tar (mg/cig) | Puff Count |
|---|---|---|---|---|---|---|
| Control | 4.09 | 9.1 | 12.53 | 0.0125 | 12.5 | 7.9 |
| 10% hydrated Fe203 | 2.87 | 8.6 | 13.25 | 0.0126 | 12.6 | 8.05 |

TABLE 2-continued

| | | | | | | |
|---|---|---|---|---|---|---|
| 20% hydrated Fe203 | 2.07 | 7.26 | 14.3 | 0.0113 | 11.3 | 8.3 |
| 30% hydrated Fe203 | 1.84 | 7.06 | 14.5 | 0.0089 | 8.9 | 6.53 |

| | CO (mg) | CO2 (mg) | O2 (mg) | CO/Tar (mg/mg) | CO/Puff (mg/puff) | Wet Tar/Puff (mg/puff) |
|---|---|---|---|---|---|---|
| Control | 13.1 | 45.7 | 45.8 | 1.05 | 1.66 | 1.58 |
| 10% hydrated Fe203 | 9.4 | 44.1 | 49.4 | 0.74 | 1.16 | 1.57 |
| 20% hydrated Fe203 | 7.0 | 38.3 | 54.9 | 0.62 | 0.84 | 1.36 |
| 30% hydrated Fe203 | 4.9 | 29.3 | 43.8 | 0.55 | 0.75 | 1.36 |

Example 3

In this example, further hand sheets were constructed containing various carbon monoxide reducing agents in accordance with the present invention. The hand sheets were compared to a control. All of the hand sheets had a 30% total filler loading, had a permeability of about 25 Coresta units, and had a basis weight of about 30 gsm. The control contained ALBACAR 5970 calcium carbonate.

The hand sheets were formed into cigarettes and the tests described in Example 1 were repeated. The following results were obtained:

TABLE 3

| Sample | BMI | Coresta | CO (%) | Wet Tar (g/cig) |
|---|---|---|---|---|
| Control | 9.68 | 13.9 | 4.7 | 0.0306 |
| Cr203 | 11.76 | 14.9 | 4.1 | 0.03317 |
| PdO | 7.17 | 14.8 | 3.2 | 0.0225 |
| CuO | 5.93 | 13.5 | 3.85 | 0.0332 |
| PtO | 5.99 | 14.1 | 4 | 0.0279 |
| hydrated Fe203 yellow10 | 13.06 | 10.30 | 2.80 | 0.02 |
| Ca02 | 8.00 | 10.60 | 3.50 | 0.03 |
| Co304 | 8.31 | 9.8 | 2.2 | 0.0172 |
| CoO | 7.70 | 10 | 4 | 0.0274 |
| CoCO3 | 14.64 | 14.4 | 2.45 | 0.0185 |

| Sample | Wet Tar (mg/cig) | Puff Count | CO (mg) | CO/Tar (mg/mg) | CO/Puff (mg/puff) | Wet Tar/Puff (mg/puff |
|---|---|---|---|---|---|---|
| Control | 30.6 | 8.2 | 15.61 | 0.51 | 1.90 | 3.73 |
| Cr203 | 33.17 | 8 | 13.28 | 0.40 | 1.66 | 4.15 |
| PdO | 22.5 | 6.5 | 8.42 | 0.37 | 1.30 | 3.46 |
| CuO | 33.2 | 9.3 | 14.50 | 0.44 | 1.56 | 3.57 |
| PtO | 27.9 | 7.2 | 11.66 | 0.42 | 1.62 | 3.88 |
| Fe203 yellow10 | 18.90 | 7.50 | 8.50 | 0.45 | 1.13 | 2.52 |
| Ca02 | 27.40 | 9.20 | 13.04 | 0.48 | 1.42 | 2.98 |
| Co304 | 17.2 | 8.8 | 7.84 | 0.46 | 0.89 | 1.95 |
| CoO | 27.4 | 8.7 | 14.09 | 0.51 | 1.62 | 3.15 |
| CoCO3 | 18.5 | 8.05 | 8.0 | 0.43 | 0.99 | 2.30 |

Example 4

Example 2 above was repeated. In this example, however, all of the wrapping papers were made on commercial paper making machines as opposed to being hand sheets made in a laboratory.

The basis weight of all of the wrapping papers was about 26 gsm. The permeability of the papers was about 24 Coresta units. Otherwise, all of the procedures described in Example 2 were repeated. The following results were obtained:

TABLE 4

| | CO (%) | CO2 (%) | O2 (%) | Wet Tar (g/cig) | Wet Tar (mg/cig) | Puff Count |
|---|---|---|---|---|---|---|
| Control | 4.09 | 9.10 | 12.53 | 0.0125 | 12.5 | 7.9 |
| 10% hydrated Fe203 | 2.87 | 8.60 | 13.25 | 0.0126 | 12.6 | 8.1 |
| 20% hydrated Fe203 | 2.07 | 7.26 | 14.30 | 0.0113 | 11.3 | 8.3 |
| 30% hydrated Fe203 | 1.84 | 7.06 | 14.50 | 0.0089 | 8.9 | 6.5 |

| | CO (mg) | CO2 (mg) | O2 (mg) | CO/Tar (mg/mg) | CO/Puff (mg/puff) | Wet Tar/Puff (mg/puff) |
|---|---|---|---|---|---|---|
| Control | 13.1 | 45.7 | 45.8 | 1.05 | 1.66 | 1.58 |
| 10% hydrated Fe203 | 9.4 | 44.1 | 49.4 | 0.74 | 1.16 | 1.57 |
| 20% hydrated Fe203 | 7.0 | 38.3 | 54.9 | 0.62 | 0.84 | 1.36 |
| 30% hydrated Fe203 | 4.9 | 29.3 | 43.8 | 0.55 | 0.75 | 1.36 |

Although various embodiments of the invention have been described using specific terms, devices, and methods, such description is for illustrative purposes only. The words used are words of description rather than of limitation. It is to be understood that changes and variations may be made by those of ordinary skill in the art without departing from the spirit or scope of the present invention. In addition, it should be understood that aspects of the various embodiments may be interchanged both in whole or in part. Therefore, the spirit and scope of the invention should not be limited to the description of the preferred versions contained therein.

What is claimed is:

1. A smoking article comprising:

a column of a smokable filler, the smokable filler comprising a tobacco; and an outer wrapper surrounding the column of a smokable filler, the outer wrapper comprising cellulose fibers combined with a colored pigment, the pigment comprising a hydrated ferric oxide, the pigment being present in the outer wrapper in an amount of at least about 10% by weight of the wrapper, the pigment being present in an amount sufficient for the smoking article to have a carbon monoxide delivery in the mainstream smoke of less than about 15 mg per smoking article and having a carbon monoxide to tar ratio of less than about 1.0.

2. A smoking article as defined in claim 1, wherein the outer wrapper further comprises a filler, the pigment and filler being present in the outer wrapper together in an amount from about 10% to about 60% by weight.

3. A smoking article as defined in claim 1, wherein the outer wrapper further comprises a burn control additive.

4. An outer wrapper as defined in claim 2, wherein the outer wrapper consists essentially of the cellulose fibers, the pigment, a filler, and a burn control additive.

5. A smoking article as defined in claim 1, wherein the smoking article has an average carbon monoxide delivery per puff of less than 1.7 mg.

6. A smoking article as defined in claim 1, wherein the pigment comprises a yellow pigment.

7. A smoking article as defined in claim 1, wherein the outer wrapper consists essentially of the cellulose fibers, the pigment, and a filler.

8. A smoking article as defined in claim 1, wherein the pigment comprises a substantially pure synthetic iron oxide yellow.

9. A smoking article comprising:

a column of a smokable filler, the smokable filler comprising a tobacco; and an outer wrapper surrounding the column of a smokable filler, the outer wrapper comprising cellulose fibers combined with a pigment, the pigment comprising a hydrated ferric oxide, the pigment being present in the outer wrapper in an amount of at least about 10% by weight of the wrapper, the pigment being present in an amount sufficient for the smoking article to have a carbon monoxide delivery in the mainstream smoke of less than about 15 mg per smoking article and having a carbon monoxide to tar ratio of less than about 1.0, the outer wrapper further comprising bands that lower ignition proclivity of the smoking article, the outer wrapper having a Burn Mode Index of less than about 8 $cm^{-1}$ within the bands, the bands having a width of at least 3 mm, the bands comprising a film-forming composition.

10. A smoking article as defined in claim 9, wherein the film-forming composition comprises a film-forming material comprising guar, pectin, polyvinyl alcohol, a cellulose derivative, a starch, a starch derivative, or mixtures thereof.

11. A smoking article as defined in claim 9, wherein the bands comprise an alginate.

12. A smoking article as defined in claim 9, wherein the outer wrapper has a band spacing of from about 10 mm to about 25 mm.

13. A smoking article as defined in claim 9, wherein the bands are spaced apart from each other longitudinally along a length of the outer wrapper.

14. A smoking article as defined in claim 9, wherein the outer wrapper further comprises a filler, the pigment and filler being present in the outer wrapper together in an amount from about 10% to about 60% by weight.

15. An outer wrapper as defined in claim 9, wherein the outer wrapper consists essentially of the cellulose fibers, the pigment, a filler, and a burn control additive.

16. A smoking article as defined in claim 9, wherein the pigment comprises a yellow pigment.

17. A smoking article as defined in claim 9, wherein the outer wrapper consists essentially of the cellulose fibers, the pigment, the bands, and a filler.

18. A smoking article as defined in claim 9, wherein the pigment comprises a substantially pure synthetic iron oxide yellow.

19. A smoking article as defined in claim 1, wherein the colored pigment is present in the outer wrapper in an amount sufficient to affect the color of the outer wrapper.

20. A smoking article as defined in claim 9, wherein the colored pigment is present in the outer wrapper in an amount sufficient to affect the color of the outer wrapper.

* * * * *